US006276070B1

(12) United States Patent
Hawley

(10) Patent No.: US 6,276,070 B1
(45) Date of Patent: Aug. 21, 2001

(54) QUILTING TOOL

(75) Inventor: Joan Hawley, Westerville, OH (US)

(73) Assignee: Lazy Girl Designs, LLC, Westerville, OH (US)

( * ) Notice: Subject to any disclaimer, the term of this patent is extended or adjusted under 35 U.S.C. 154(b) by 0 days.

(21) Appl. No.: 09/458,863

(22) Filed: Dec. 10, 1999

Related U.S. Application Data

(60) Provisional application No. 60/112,665, filed on Dec. 17, 1998.

(51) Int. Cl.[7] ..... B43L 7/033; B43L 13/20

(52) U.S. Cl. ..... 33/563; 33/482; 33/1 G

(58) Field of Search ..... 33/1 G, 1 AP, 33/11, 12, 14, 16, 482, 494, 562, 563

(56) References Cited

U.S. PATENT DOCUMENTS

| | | | | |
|---|---|---|---|---|
| 183,076 | * | 10/1876 | Somes | 33/482 |
| 194,086 | * | 8/1877 | Griffin | 33/16 |
| 937,214 | * | 10/1909 | Kellogg | 33/11 |
| 1,473,241 | * | 11/1923 | McCormick et al. | 33/11 |
| 1,742,684 | * | 1/1930 | Bowman | 33/563 |
| 2,068,684 | * | 1/1937 | Kravitz | 33/12 |
| 5,201,783 | * | 4/1993 | Peters | 33/474 |
| 5,557,996 | * | 9/1996 | Reber et al. | 33/563 |
| 5,579,670 | * | 12/1996 | McCormick | 33/562 |
| 6,158,135 | * | 12/2000 | Rank | 33/494 |

OTHER PUBLICATIONS

Mitchell, *Perfect Patchwork Templates* brochure, undated.
Zimmerman et al., *Quilt House Tri–Recs Tools* brochure, undated.
*Kaleido–Ruler,* undated.
Hultgren, *Quilt House Easy Angle* ruler, undated.
*Acrylic Tools for Popular Quilting Shapes—Fast and Easy* brochure, undated.

* cited by examiner

*Primary Examiner*—G. Bradley Bennett
(74) *Attorney, Agent, or Firm*—Michael S. Sherrill

(57) ABSTRACT

The quilting tool has at least one surface defining an angle of 116.6 degrees. A transparent plate is imprinted with at least two guidelines allowing the cutting off of a portion of a fabric strip, resulting in a trapezoidal fabric pattern.

24 Claims, 11 Drawing Sheets

QUILTING TOOL

This application claims the benefit of provisional patent application Ser. No. 60/112,665 filed Dec. 17, 1998.

FIELD OF THE INVENTION

This invention relates to devices used to measure angles and distances in cutting pieces of fabric which are later sewn together to create artistic designs in quilt making.

BACKGROUND

Quilt making is a traditional art performed by many artisans. Quilts are traditionally made by precisely cutting pieces of fabric having different shape, color, design, and texture, then sewing the fabric pieces together to form a block having a particular design. The individual blocks are eventually sewn together according to a master design, which forms the cover of the quilt. While a completed quilt has practical applications in the home, very beautiful artistic designs are frequently employed in completing the finished quilt, thus, quilt making is considered an art form.

Ordinarily, geometric patterns are incorporated into the overall design of the quilt. Frequently, two different shapes are employed in creating the design, trapezoidal and triangular. The angles and lengths of the individual trapezoidal and triangular pieces must be sufficiently precise so that straight edges will eventually line up with other pieces of fabric at the proper angle in accord with the master design of the quilt.

Several possible solutions to this problem have been proposed. THE EASY ANGLE™ cutting guideline, distributed by Quilt House, Saddle Brook, N.J., is a transparent piece of plastic in the form of right triangle having gradated lines at crossing right angles to the right angle etched into its surface. The quilter using THE EASY ANGLE™ is limited by this device to making equilateral triangle shaped pieces. The TRI TooL™ and RECS TOOL™, distributed by Quilt House, Saddle Brook, N.J., are also transparent plastic triangles having gradated lines etched into their surfaces. These tools have imprinted on their surfaces a series of parallel, gradated lines corresponding with the X-axis of the triangle. The TRi TOOL™ is used for cutting pieces to be arranged as triangles or triangles within squares having a height that is equal to the width of the base of the triangle. The RECS TOOL™ is used to cut pieces when finished to be used as 1×2 proportion triangles, having a height that is two times the width of the base of the triangle. Both the TRI TOOL™ and the RECS TOOL™, of necessity, come in a wide range of sizes. Perfect Patchwork Templates are distributed by Michell Marketing, Inc., and comprise a set of clear plastic pieces that are used as templates for cutting out a specifically sized and shaped piece of fabric. Perfect Patchwork Templates contain no gradated lines and are only used as outer templates for cutting out fabric pieces in different sizes and shapes. KALEIDO-GUIDELINE™ is distributed by Michell Marketing, Inc., Atlanta, Ga. and comprises a clear piece of plastic having a series of gradated lines etched into its surface. The angles represented by KALEIDO-GUIDELINE™ are peculiar to a "kaleidoscope" or pattern of radially arranged fabric pieces.

The devices discussed above all contain limitations making them difficult or inconvenient to use. As discussed, some of the devices, by their nature, require completely separate units to cut pieces of fabric having different sizes and angular configurations. The result of multiple devices of many sizes is that a number of devices decrease efficiency by occupying space, and, inevitably, some get lost. The one piece devices are generally limited to assisting in cutting out a single type of piece, requiring multiple units and resulting in similar problems as the single size units discussed above. Further, none of the devices discussed above are capable of creating trapezoidal shaped pieces that are combinable with an appropriately sized block comprising a 1×2 right triangle with integrally attached ¼" seam allowance to create a finished piece having a square shape after all seams are sewn. Finally, none of the devices discussed above are capable of creating a square pattern from a combined trapezoidal piece and an appropriately sized trapezoidal block comprising a 1×2 right triangle with integrally attached ¼" seam allowance 1×2 right triangle that has a seam extending precisely from a corner of the finished square piece to the exact midpoint of a side of the square after all seams are sewn. What is clearly needed is a single unit that combines the functions of a plurality of separate units, allows both A trapezoidal shaped blocks and B trapezoidal blocks comprising a 1×2 right triangle with integrally attached ¼" seam allowance to be quickly and easily cut, and assures precise alignment of the pieces resulting in a seam extending from a corner of the square to the exact midpoint of another side.

SUMMARY OF THE INVENTION

The present claimed invention is directed to a quilting tool comprising a transparent plate having at least a straight edge and an angular edge, the angular edge joining the straight edge to form an angle of 116.6 degrees. The plate has imprinted on it a first guideline extending from the straight edge at an angle of 90 degrees. Parallel with the straight edge is a second guideline imprinted on the plate, with the second guideline intersecting the first guideline at a 90-degree angle and extending toward and terminating at the angled edge.

An alternative embodiment of the present claimed invention is directed to a quilting tool comprising a transparent plate having four edges. The first edge is parallel with the second edge. The third edge intersects with the first and second edges to form right angles. The fourth edge intersects with the second edge to form an angle of 116.6 degrees.

The quilting tool of the alternative embodiment of the present claimed invention contains four distinct sets of guidelines that are visible through the transparent plate on both sides. A third set of guidelines is parallel with each other and forms right angles with the third edge. A fourth set of guidelines is parallel with each other and disposed at an angle parallel with the fourth edge and begins at the first edge and is similarly spaced with the third set of guidelines and terminates at the junction with the third set of guidelines. A first set of guidelines is parallel with each other and is parallel with the third edge and extends at a ninety-degree angle from the second edge. A second set of guidelines is parallel with each other and terminates at the junction with the first set of guidelines.

The quilting tool of the present invention allows the quick, easy and precise cutting of both an A trapezoidal block and a B trapezoidal block comprising a 1×2 right triangle with integrally attached ¼" seam allowance to be cut from precut fabric strips. The resulting pieces can then be sewn together to form a finished square block having a seam that begins at one corner of the square and extends to the exact midpoint of another side. This allows the quilter greater flexibility in design by permitting individual squares to be expanded into what appear to be larger patterns.

Finally, blocks made using the present claimed invention can be joined with blocks made using other methods.

DETAILED DESCRIPTION OF THE INVENTION INCLUDING A BEST MODE

Definitions

"Block" refers to an unfinished piece of cloth that will later be sewn together with another block.

"A trapezoidal block" refers to a block defined as a square minus a section defined by a line extending from a point half the length of one of the sides to a corner of another side, plus a uniform amount of seam allowance at the perimeter.

"A block" is analogous to "A trapezoidal block".

"B trapezoidal block" refers to a trapezoid comprising a right triangle having 1×2 proportions, plus an amount of seam allowance at the perimeter.

"B block" is analogous to "B trapezoidal block".

"Pattern" refers to a finished piece of cloth having a design created by sewing together various blocks.

Nomenclature

Figure 1:
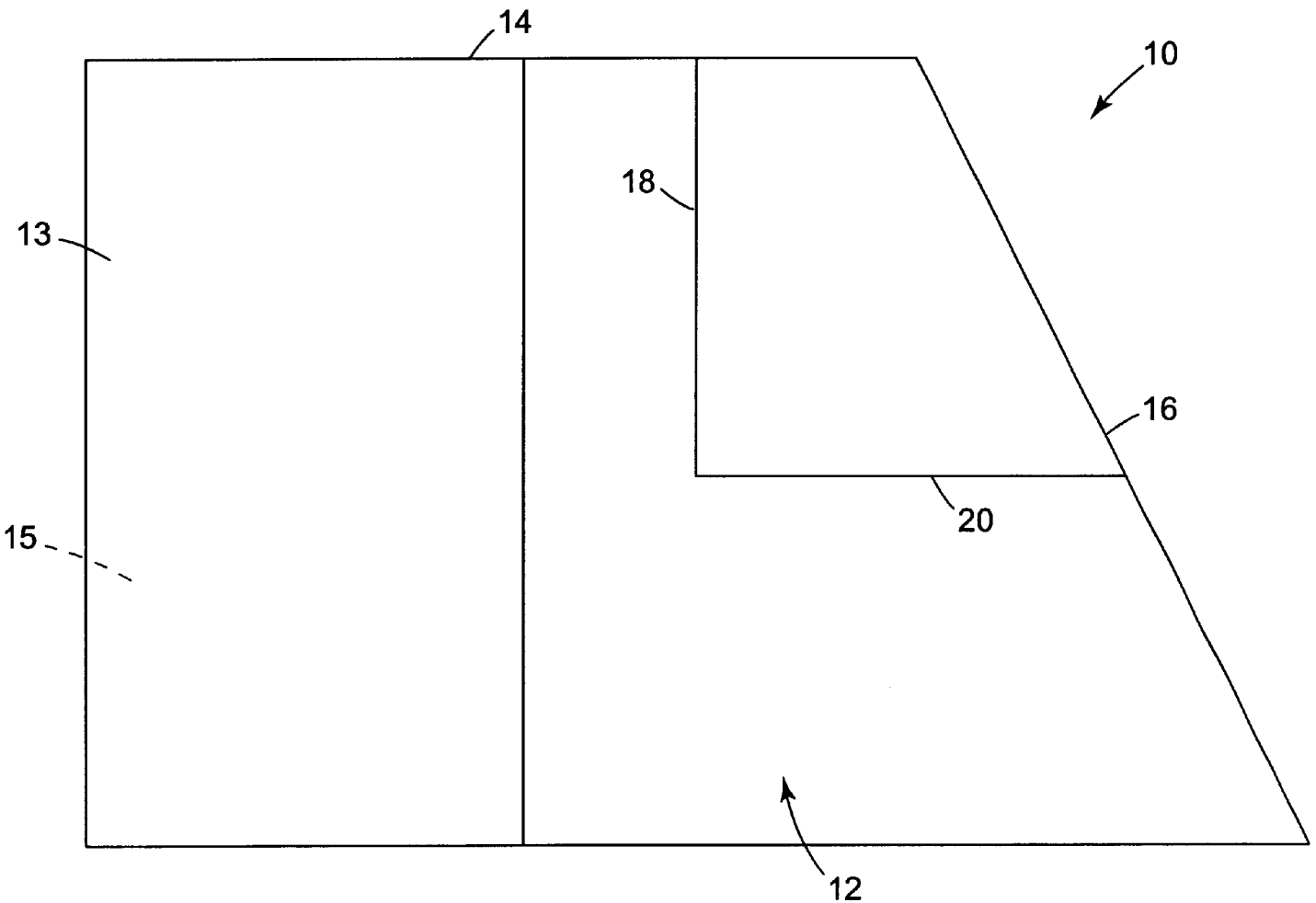
FIG. 1 is a plan view of an embodiment of the invention.

10 First Embodiment of Quilting Tool
12 Plate
13 First Major Surface
14 Straight Edge
15 Second Major Surface
16 Angled Edge
18 First Straight Guideline
20 Second Straight Guideline
25 Second Embodiment of Quilting Tool
30 First Set of Guidelines
32 Second Set of Guidelines
110 Third Embodiment of Quilting Tool
112 Plate
114 First Major Surface
115 Alpha-Numeric Characters
116 Second Major Surface
118 First Edge
120 Second Edge
122 Third Edge
124 Fourth Edge
140 Third Set of Guidelines
142 Third Set of Seam Lines
144 Fourth Set of Guidelines
146 Fourth Set of Seam Lines
148 Reference Line
150 Seam line Associated with Reference line
152 First Set of Guidelines
154 First Set of Seam Lines
156 Second Set of Guidelines
158 Second Set of Seam Lines
160 Vertical Line
162 Seam line Associated with Vertical Line
164 Seam line Associated with Fourth Edge
166 Seam line Associated with First Edge
168 Seam line Associated with Third Edge
170 Seam line Associated with Second Edge
200 A Block
201 End Point of Base Side
202 Base Side
203 A Pattern
204 Parallel Side
205 Termination point of Parallel Side
206 Cross Side
208 Angled Side
220 B Block
221 Finished B Pattern
222 Vertical Side
224 Horizontal Side
226 Hypotenuse Side
230 Square Block
232 Seam
234 Top Side
236 Bottom Side
238 Left Side
240 Right Side
242 Corner of Finished Block
244 Midpoint of Seam
250 Square Block Combining One A Block with Two B Blocks
260 Square Block Combining One A Block with Two B Blocks
270 Square Block Combining One A Block with Two B Blocks
280 Rectangular Block Combining Two A Blocks
290 Rectangular Block Combining Two B Blocks
SA Seam Allowance Construction As shown in FIG. 1, a first embodiment of the quilting tool 10 comprises a plate 12 of planar transparent material capable of permanent inscription. The plate 12 defines a first major surface 13 and a second major surface 15. The rigid, transparent material can be any of a number of materials such as glass, or various kinds of plastic such as acrylic, polycarbonate, polystyrene, or other plastic materials, as long as the material is transparent and sufficiently rugged to withstand the rigors of a cutting means repeatedly contacting a cutting side.

Figure 4:
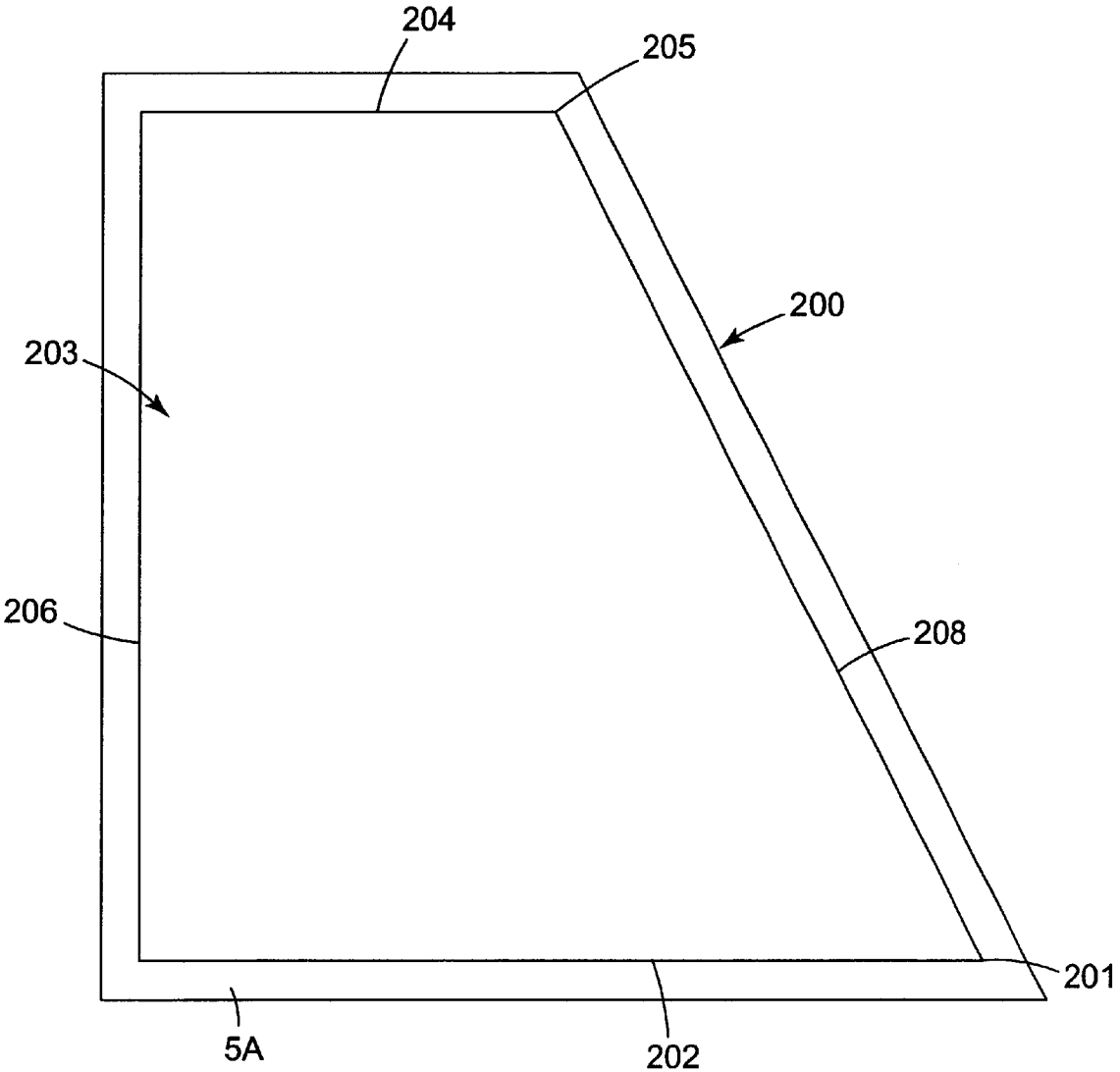
FIG. 4 is a plan view of a pattern created by using the present claimed invention.

The quilting tool 10 comprises a straight edge 14 which joins an angled edge 16 to form an angle of 116.6 degrees. A first straight guideline 18,is imprinted onto the plate 12 and extends from the straight edge 14 at a 90-degree angle. A second straight guideline 20 extends from the termination point of the first guideline 18 at a 90-degree angle to the angled edge 16. The significance of the 116.6 degree angle is that it allows the creation of an A pattern 203 as shown in FIG. 4. The full significance of an A block 200 in quilting is more fully discussed below. However, an A pattern 203 is a square minus a space defined by an angle extending from the termination point 205 of the parallel side 204, to an end point of the base side 201 formed by two other sides of the A pattern 203.

Figure 2:
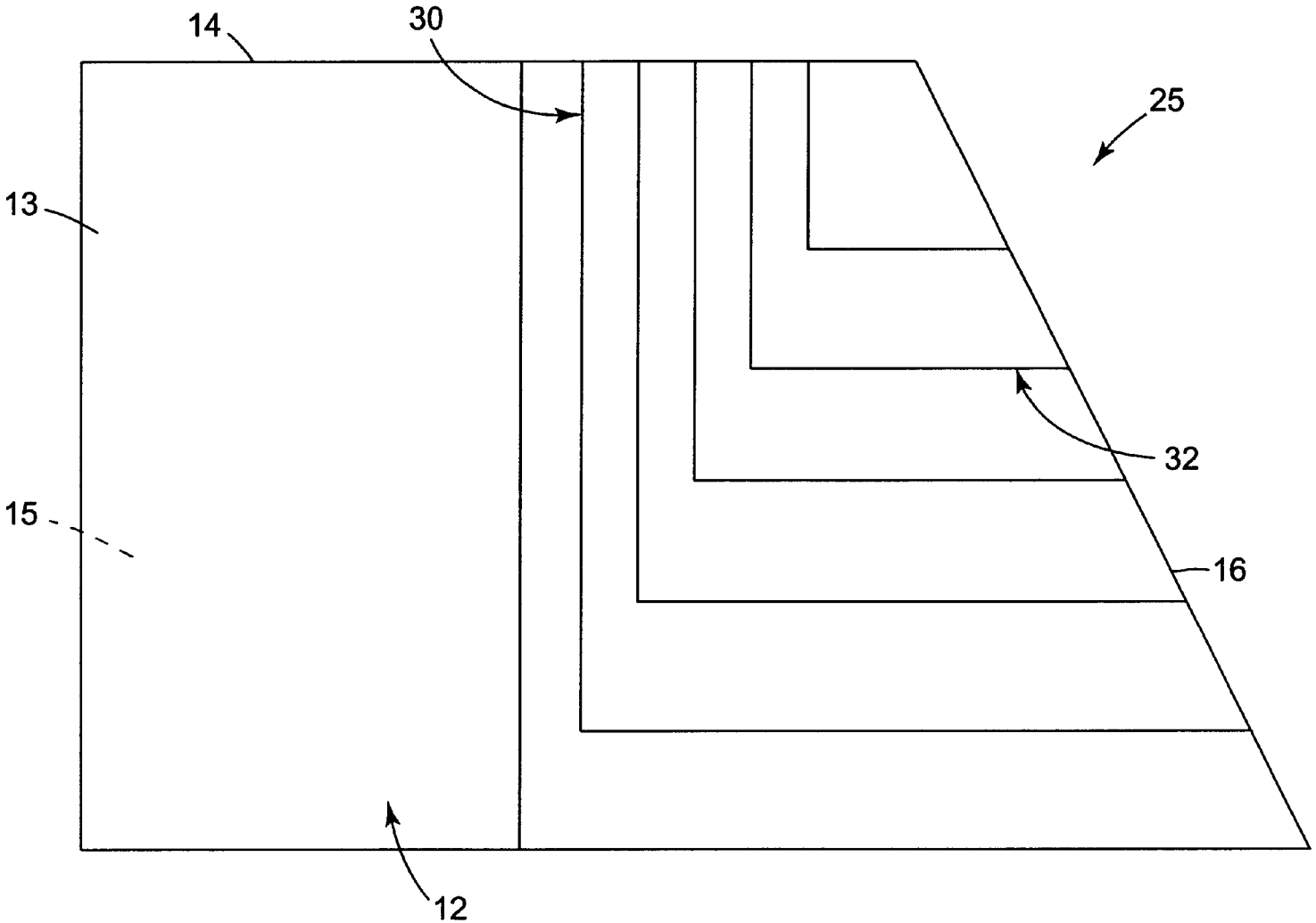
FIG. 2 is a plan view of an alternative embodiment of the invention.

As shown in FIG. 2, a second embodiment of the quilting tool 25 comprises a plate 12 of planar transparent material capable of permanent inscription. The plate 12 defines a first major surface 13 and a second major surface 15. The transparent material can be any of a number of materials such as glass, or various kinds of plastic such as acrylic, polycarbonate, polystyrene, or other plastic materials, as long as the material is transparent and sufficiently rugged to withstand the rigors of a cutting means repeatedly contacting a cutting side.

The second embodiment of the quilting tool 25 comprises a straight edge 14 which joins an angled edge 16 to form an angle of 116.6 degrees. A first set of guidelines 30 is imprinted onto the plate 12 and extends from the straight edge 14 at a 90-degree angle. A second set of guidelines 32 extends from the termination point of the first set of guidelines 30 at a 90-degree angle to the angled edge 16. The significance of the 116.6 degree angle is that it allows the creation of an A block 200 as shown in FIG. 4.

Figure 3:
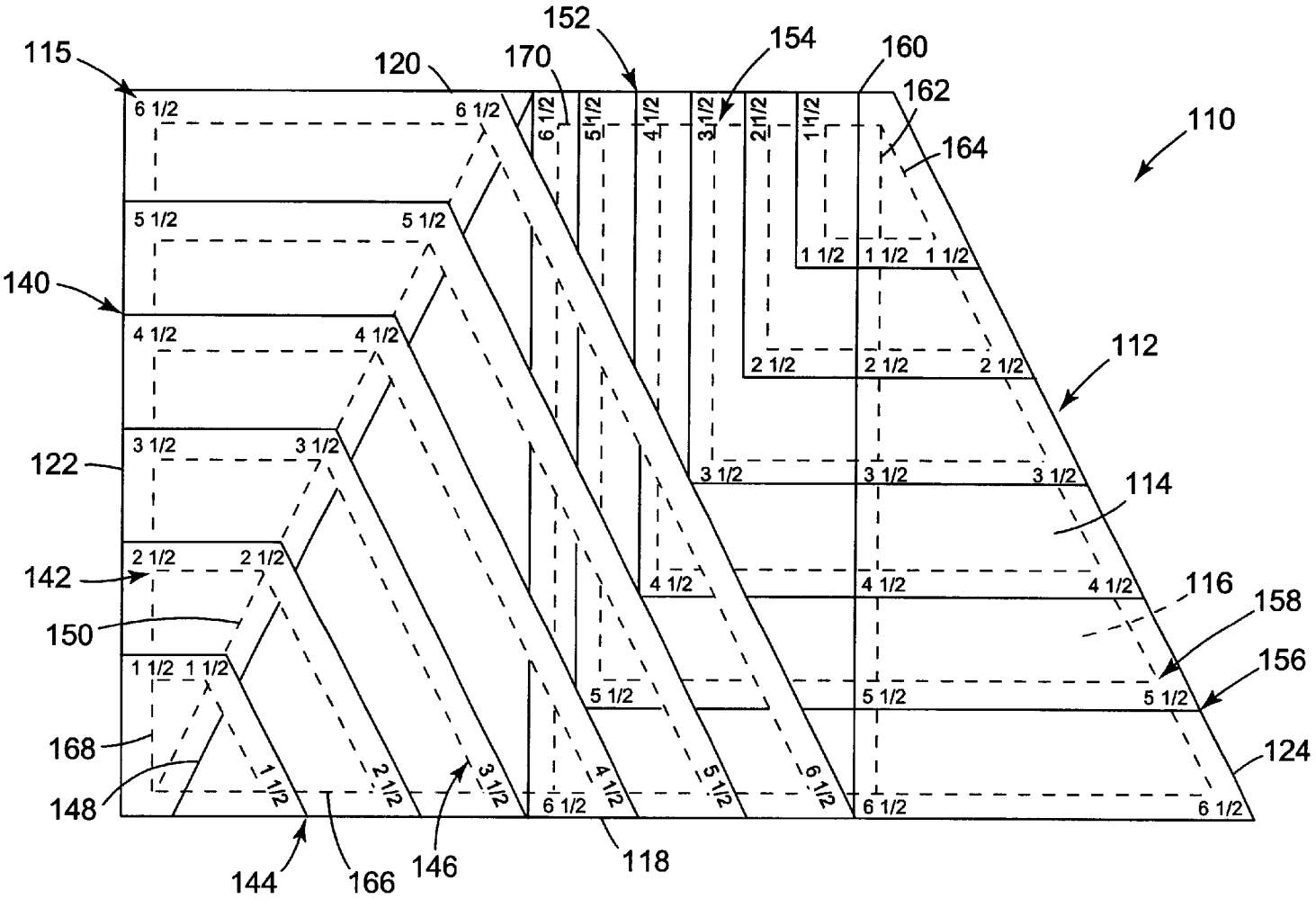
FIG. 3 is a plan view of an another embodiment of the invention.

As shown in FIG. 3, a third, preferred, embodiment of the quilting tool 110 comprises a plate 112 made of a single piece of planar transparent material capable of permanent inscription. The transparent material can be any of a number of materials such as glass, or various kinds of plastic such as acrylic, polycarbonate, and polystyrene. In a preferred embodiment, a piece of ⅛ inch thick acrylic material is used, however, other materials and thicknesses will also work. The plate 112 defines a first major surface 114 and a second major surface 116. Also defined are a first edge 118 and a second edge 120, which are parallel with each other. A third edge 122 intersects with the first edge 118 and second edge 120 at right angles. A fourth edge 124 intersects with the second edge 120 to form an angle of 116.6 degrees. The fourth edge 124 intersects with the first edge 118 to form an angle of 63.4 degrees.

A series of characters is permanently imprinted on either the first major surface 114 or in a preferred embodiment, the second major surface 116, or both first 114 and second major surfaces 116. Various means of imprinting the device of the present claimed invention include chemical, mechanical or laser etching, engraving, or, in a preferred embodiment, printing with permanent ink. The characters can consist of solid or broken lines as discussed below, or alphanumeric characters 115 as required.

A first set of guidelines 152 comprises a series of parallel lines of progressively increasing length in a stacked configuration and is disposed parallel with the third edge 122. A first set of seam lines 154 comprises a series of parallel lines visually distinct from the first set of guidelines 152 in a stacked configuration and is disposed parallel with the first set of guidelines 152. The significance of the seam lines 154 is that the size of the finished block size minus the seam allowance will be visible to the user while using the quilting tool 110. In a preferred embodiment, the distance between a guideline and its associated seam line is ¼ inch. A multitude of other defined distances is also possible, thus the scope of the invention should not be limited to this particular dimension.

A second set of guidelines 156 comprises a series of parallel lines of progressively increasing length in a stacked configuration and is disposed parallel with the first edge 118. A second set of seam lines 158 comprises a series of parallel lines visually distinct from the second set of guidelines 156 in a stacked configuration and is disposed parallel and in close association with the second set of guidelines 156. The individual lines of the first set of guidelines 152 and corresponding individual lines of the second set of guidelines 156 join at common intersections to form right angles. In a similar manner, the individual lines of the first set of seam lines 154 and corresponding individual lines of the second set of seam lines 158 join at common points to form right angles. In all instances disclosed, the individual lines comprising a set of guidelines and a corresponding set of seam lines are made of lines of progressively increasing length. Alphanumeric characters 115 may, in a preferred embodiment, be included or may not be included to indicate which set of guidelines is being used. A vertical line 160, which is parallel with the third edge 122 extends from the second edge 120 to the first edge 118 to form a trapezoid that when all seams are sewn forms a right triangle. A seam line 162 is parallel with and associated with the vertical line 160.

A third set of guidelines 140 comprises a series of parallel lines of progressively increasing length in a stacked configuration, and is disposed parallel with the first edge 118 and the second edge 120, and at right angles to the third edge 122. The third set of guidelines 140 is disposed as a plurality of parallel lines spaced at even intervals of 1.5, 2.5, 3.5, 4.5, 5.5, and 6.5 inches. While this spacing represents a preferred embodiment of the present claimed invention, an infinite variety and number of spacings is possible, thus the forgoing example should be viewed as illustrative and not limiting the scope of the invention as claimed. A third set of seam lines 142 comprises a series of parallel lines visually distinct from the third set of guidelines 140 of progressively increasing length in a stacked configuration and is disposed in parallel with and in close association with the third set of guidelines 140.

A fourth set of guidelines 144 comprises a series of parallel lines of progressively increasing length in a stacked configuration and is disposed parallel with the fourth edge 124. The fourth set of guidelines 144 is configured in the same number and spacing as the third set of guidelines 140 and intersects with the third set of guidelines 140 at an angle of approximately 116.6 degrees. A fourth set of seam lines 146 is disposed in parallel with and closely associated with the fourth set of guidelines 144 in the same manner as the third set of seam lines 142 to the third set of guidelines 140. The fourth set of seam lines 146 is visually distinct from the fourth set of guidelines 144.

A reference line 148 extends from the second edge 120 at a mirror image angle to the 116.6 degree angle formed by the intersection of the second edge 120 and the fourth edge 124, to a point 0.40 inches from the intersection of the first edge 118 and the third edge 122. This distance is the same distance from the intersection of the first edge 118 and the third edge 122 as is the vertical line 160 from the intersection of the second edge 120 and the fourth edge 124. Parallel with and associated with the reference line 148 is a seam line 150. A seam line 166 is parallel and associated with the first edge 118. Another seam line 168 is parallel and associated with the third edge 122. A seam line 164 is parallel with and associated with the fourth edge 124. A seam line 170 is parallel with and associated with the second edge 120.

Use

The present claimed invention is used to create fabric blocks by combining two or more blocks which may or may not be different. FIG. 4 shows an A block 200, which is a trapezoidal shape. It should be noted that the A block 200 is shown with the seam allowance SA still attached. The seam allowance SA comprises an amount of cloth outside the desired finished A pattern 203, which allows various blocks to be sewn together to create a wide variety of finished designs. After the A block 200 is combined with another block and all seams are sewn, the finished A pattern 203 has a base side 202 twice as long as its parallel side 204. A cross side 206 having the same length as the base side 202 intersects the base side 202 and parallel side 204 at right angles. An angled side 208 extends from the termination point 205 of the parallel side 204 to an end point 201 of the base side 202 to complete the A pattern 203. Sides 204 and 208 intersect at a 116.6 degree angle.

Figure 5:
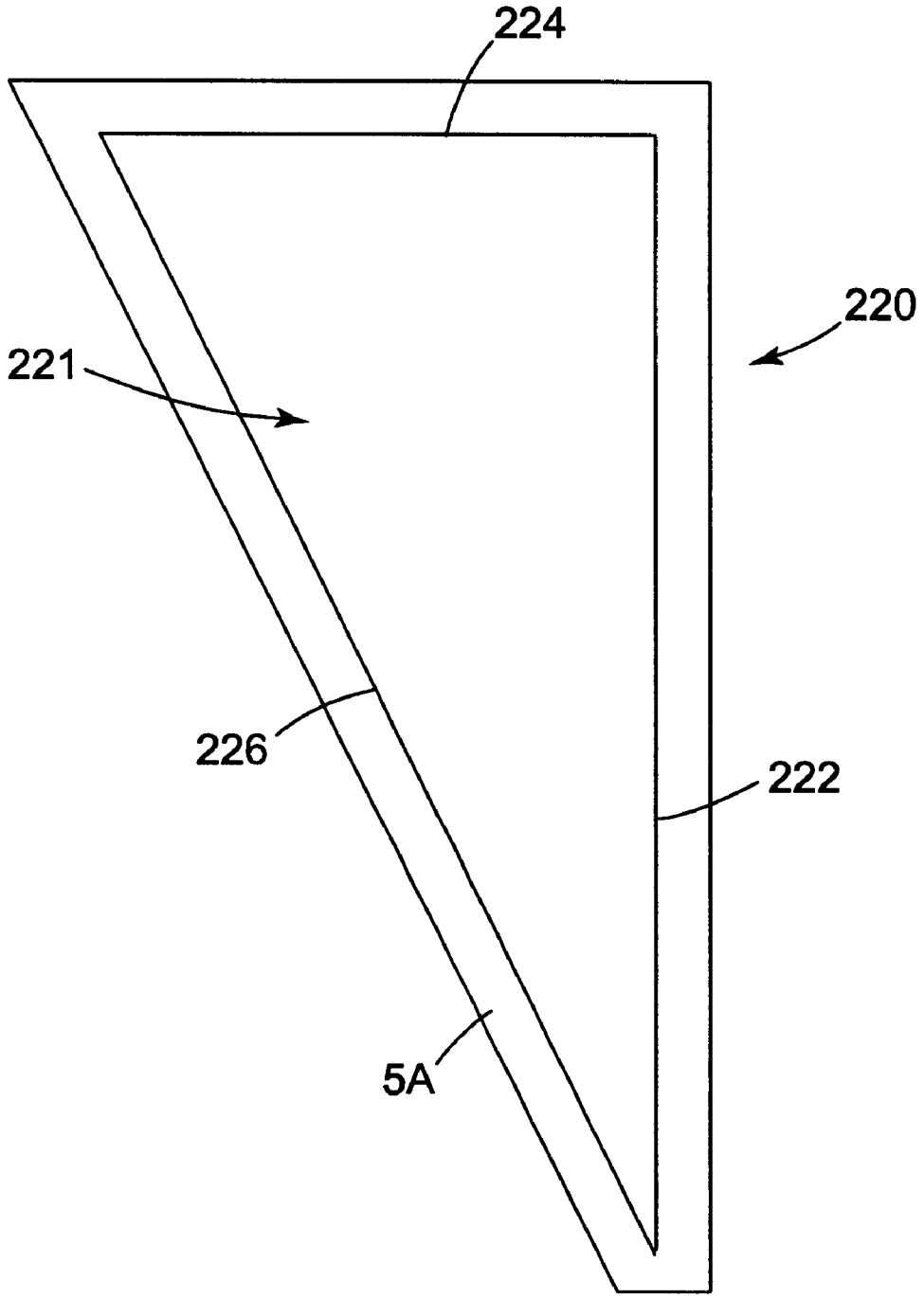
FIG. 5 is a plan view of a pattern created by using the present claimed invention.

As shown in FIG. 5, a B block 220 comprises a trapezoidal shape. It should be noted that the B block 220 is shown with the seam allowance SA still attached. The seam allowance SA comprises an amount of cloth outside the desired finished pattern, which allows various blocks to be sewn together to create a wide variety of finished designs. After the B block 220 is combined with another block and all seams are sewn, a finished B pattern 221, which is a right triangle having a horizontal side 224 intersecting a vertical side 222 results. The horizontal side 224 and vertical side 222 are intersected by a hypotenuse side 226 to complete the finished, triangular B pattern 221. The proportion of the length of the vertical side 222 is twice the length of the horizontal side 224. The length of the vertical side 222 is equal to the length of the base side 202 and the cross side 206 of an A pattern 203. The hypotenuse side 226 is equal in length to the angled side 208 of an A pattern 203, of corresponding size.

Figure 6:
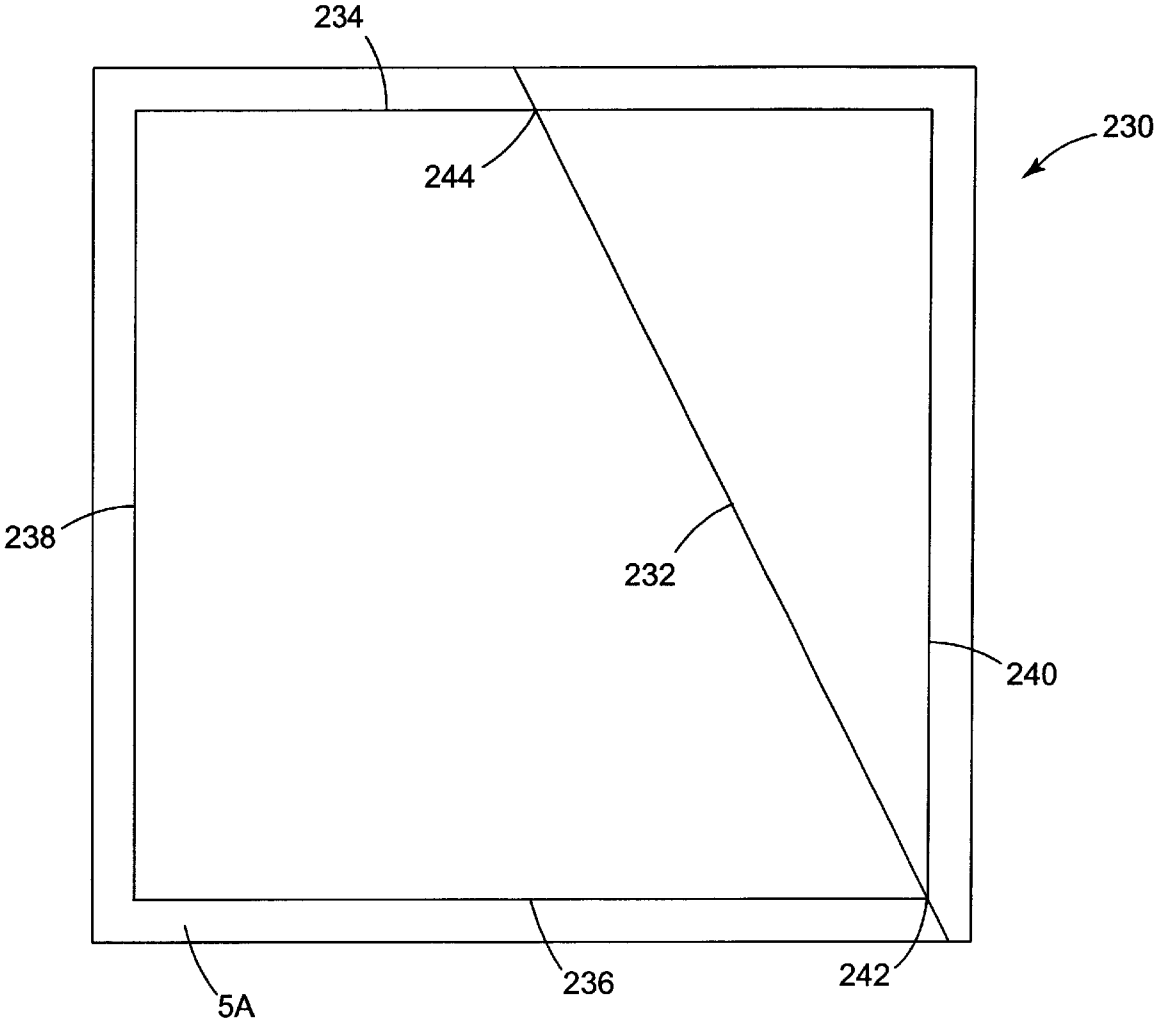
FIG. 6 is a plan view of a pattern created by combining the patterns of FIG. 4 and FIG. 5.

As shown in FIG. 6, when an A block 200 and a B block 220 are combined, after all seams are sewn, a square block 230 is created. A seam 232 extends between the angled side 208 of the A pattern 200, and the hypotenuse side 226 of the B pattern 220. A finished square block 230 results having a seam 232 extending from a comer 242 of the finished block to the midpoint 244 of one of the sides of the finished square block 230. The finished square block 230 contains a top side 234, bottom side 236, left side 238, and right side 240, all of which have equal length with each other.

Figure 7:
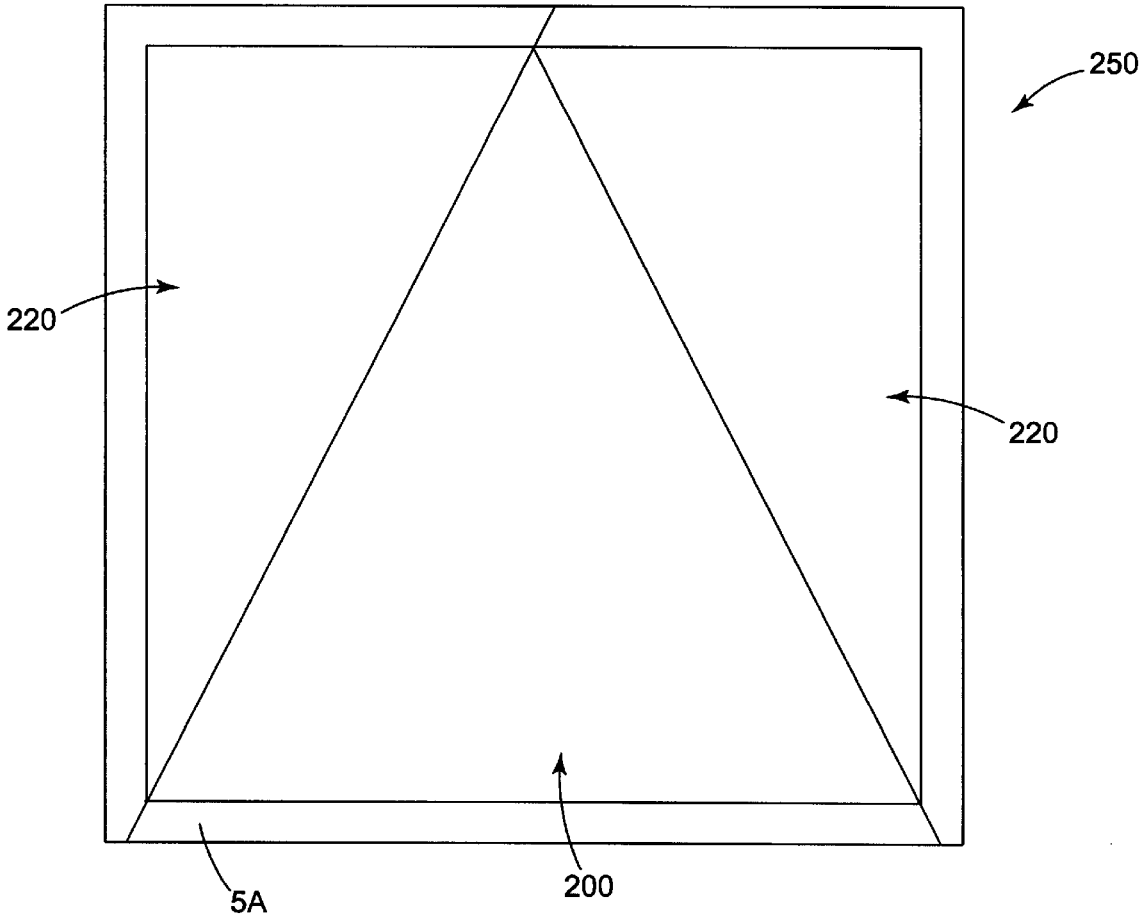
FIG. 7 is a plan view of another pattern created by combining the patterns of FIG. 4 and FIG. 5.
Figure 8:
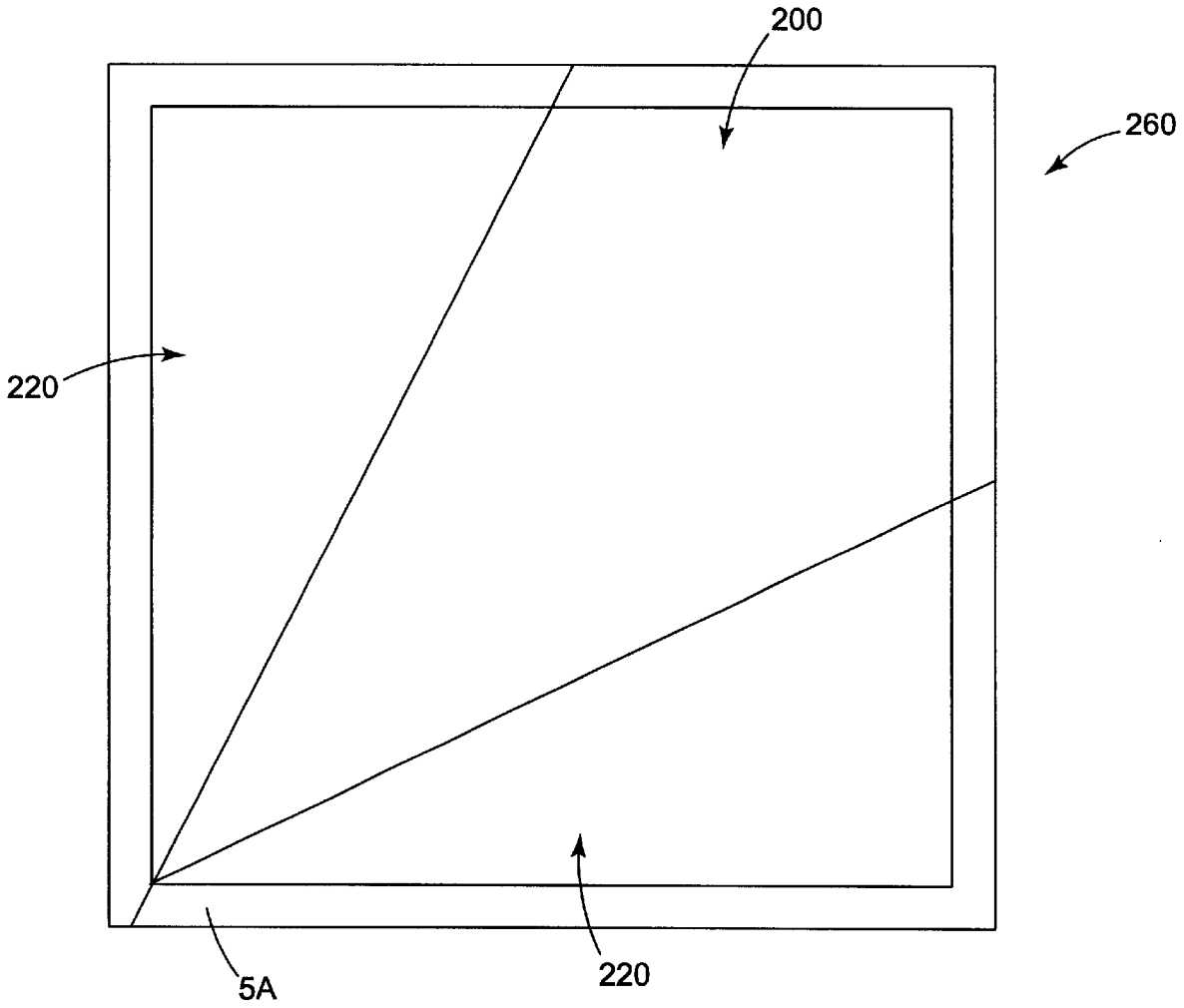
FIG. 8 is a plan view of an additional pattern created by combining the patterns of FIG. 4 and FIG. 5.
Figure 9:
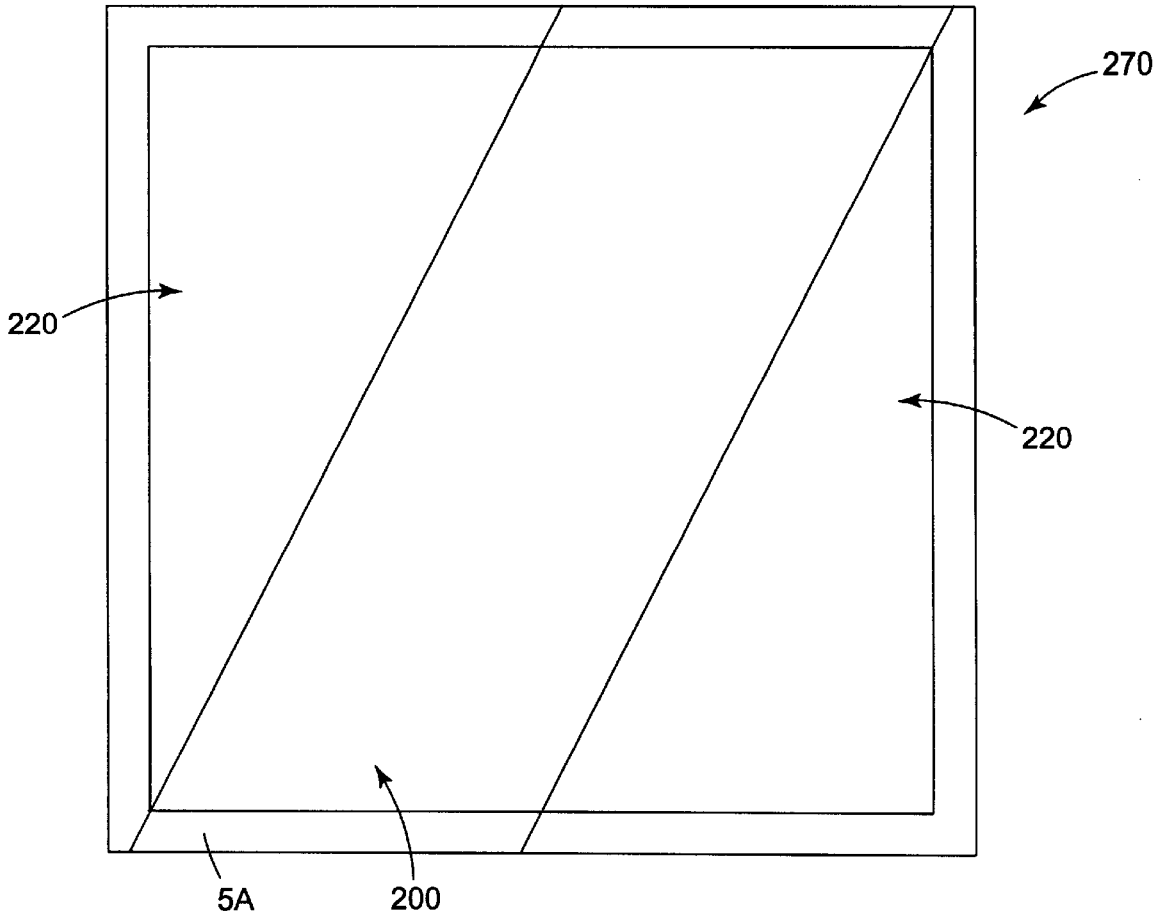
FIG. 9 is a plan view of an alternative pattern created by combining the patterns of FIG. 4 and FIG. 5.

FIGS. 7, 8 and 9 show a sampling of the almost unlimited plurality of block patterns 250, 260, 270 possible by combining the basic A block 200 with one or more B blocks 220. It should be noted that the blocks are shown with the seam allowance SA attached to the perimeter of the block. The seam allowance SA allows the finished blocks to be sewn together with other finished blocks in a manner allowing a hidden seam so as not to interfere with the quiltmaker's design. The block designs are combinable with other blocks to create colorful and creative quilt designs. One of the advantages of using blocks created by patterns made possible by the third embodiment of the quilting tool 110 of the present claimed invention is that seams created by different combinations of A 200 and B 220 blocks result in angles that are alignable with complimentary angles in other blocks to create patterns having larger dimensions. One effect that can be achieved by using this technique is expandability. Expandability occurs when blocks having a common size and complimentary angular design are combined. This is due to the angular nature inherent in the A block 200 and the precision made possible by the present claimed invention. Expandability gives the illusion that much larger patterns are present in the design of the quilt than are possible by conventional quilting techniques. Another advantage of using blocks created using the present claimed invention is that the blocks are fully compatible with blocks made using other tools and techniques.

Figure 10:
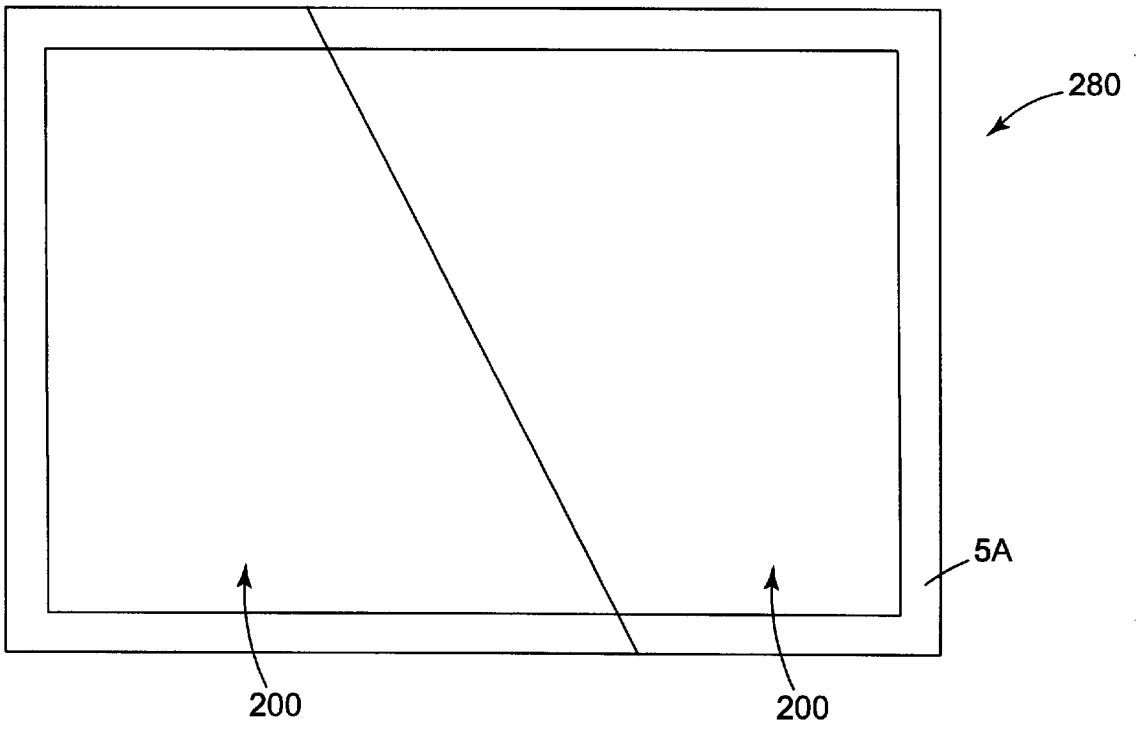
FIG. 10 is a plan view of an alternative pattern created by combining two patterns of FIG. 4.

As shown in FIG. 10, two A blocks 200 can be combined to create a rectangular block 280.

Figure 11:
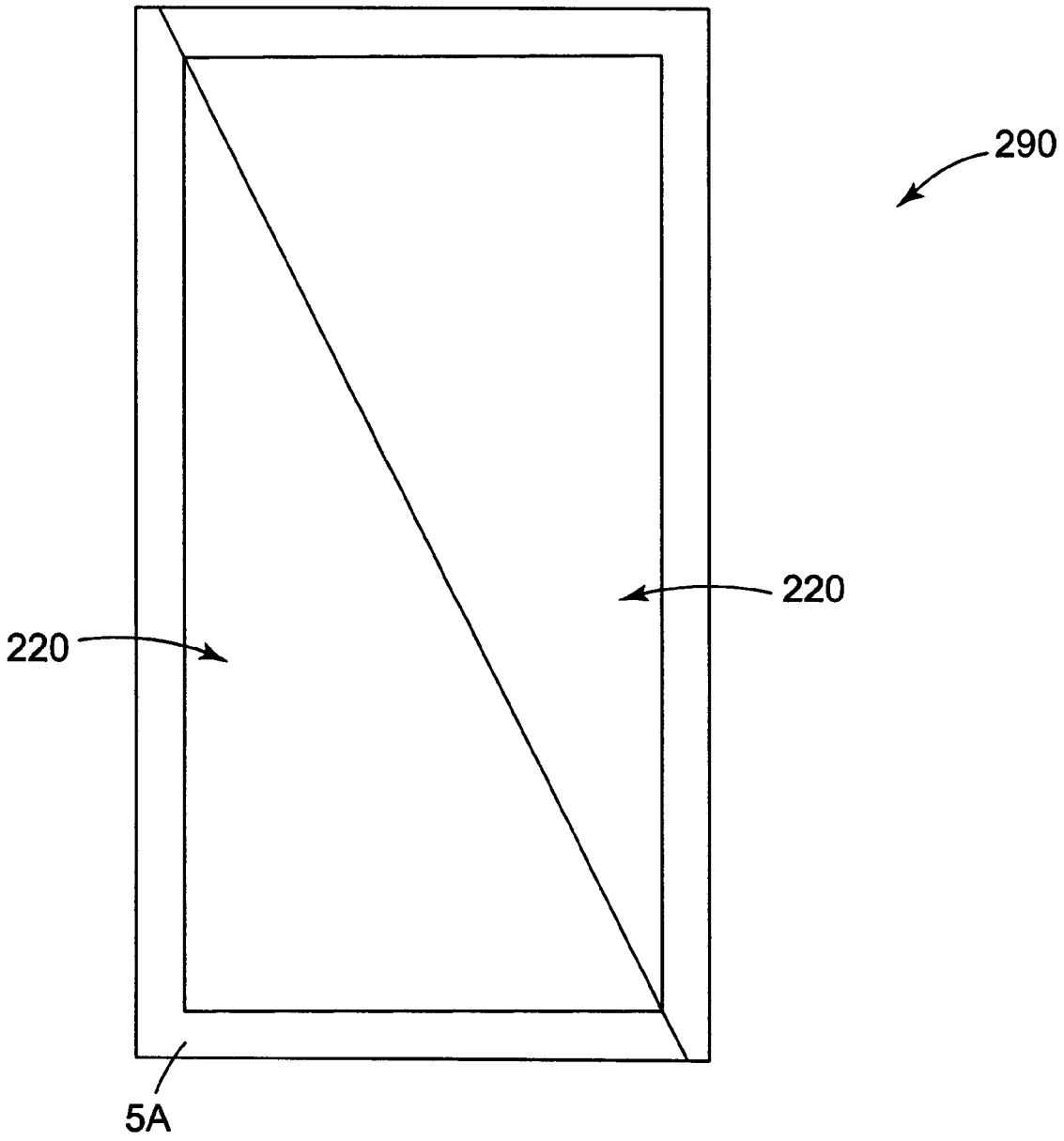
FIG. 11 is a plan view of an alternative pattern created by combining two patterns of FIG. 5.

As shown in FIG. 11, two B blocks 220 can be combined to create a rectangular block 290.

Using the first embodiment of the quilting tool 10 shown in FIG. 1 first requires the preparation of a fabric strip (not shown) having a uniform width equal to the width of the area between the straight edge 14 and the second guideline 20. The prepared fabric strip is placed on a suitable cutting surface, followed by placing the quilting tool 10 over the fabric strip. This is followed by aligning the quilting tool 10 such that the width of the fabric strip is encompassed within the space defined by the straight edge 14 and the second guideline 20. The fabric strip should have a trimmed edge having 90 degree angles and this fabric edge is aligned with the first guideline 18. A sufficient amount of fabric must extend past the area covered by the quilting tool 10 to allow cutting. Finally, a suitable cutting means is used to cut the fabric at the angle determined by the angle formed by the angled edge 16. This results in an A block 200 piece of fabric as shown in FIG. 4.

Using the second embodiment of the quilting tool 25 shown in FIG. 2 first requires the preparation of a fabric strip (not shown) having a uniform width equal to the width of the area between the straight edge 14 and an individual guideline of the second set of guidelines 32, corresponding with the width of the precut fabric strip. The fabric strip is placed on a suitable cutting surface, followed by placing the quilting tool 25 over the fabric strip. This is followed by aligning the quilting tool 25 such that the width of the fabric strip is encompassed within the space defined by the straight edge 14 and the second guideline 32. The fabric strip should have a trimmed edge having 90 degree angles and this edge is aligned with the first guideline 30. A sufficient amount of fabric must extend past the area covered by the quilting tool 25 to allow cutting. Finally, a suitable cutting means is used to cut the fabric at the angle determined by the angle formed by the intersection of the straight side 14 and the angled edge 16. This results in an A block 200 piece of fabric as shown in FIG. 4.

Referring to the third embodiment of the quilting tool 110 disclosed in FIG. 3, using the present claimed invention first requires the preparation of a fabric strip (not shown) having a uniform width corresponding to two sides of the desired finished block size plus the amount of bias. A seam allowance of ¼ inch is commonly used by quilters for the purpose of providing an extra amount of fabric to be used in creating a hidden seam when sewing two pieces of fabric together. Thus, if ¼ inch seam allowance is desired, an excess width of ½ inch should be added when preparing the fabric strip and also when cutting the piece from the fabric strip. This step is automatically performed when using the quilting tool 110 by aligning the precut fabric strip with the second guideline matching the size of the precut fabric strip. The corresponding seam line indicates the size and shape of the finished fabric pattern when it is eventually sewn together. For example, if a four inch finished block is desired, a fabric strip of 4¼ inches should be used. The end of the fabric strip containing the selvage should be trimmed at a right or ninety degree angle. Using the quilting tool 110, it is possible to cut mirror image shaped pieces by simply doubling the fabric strip when cutting. Mirror image pieces are desirable when creating designs requiring symmetry.

To cut an A block 200 using the third embodiment of the quilting tool 110, as shown in FIG. 3, the properly sized and trimmed fabric strip is first placed on a suitably sized cut resistant surface. This is followed by overlaying the quilting tool 110 of the present claimed invention on the fabric strip. Next, the fabric strip is positioned under the quilting tool 110 with the trimmed right angle end aligned with the member of the first 152 and second 156 set of guidelines corresponding with the width of the fabric strip. For example, if a fabric strip of 4¼ inches is used, the strip should be aligned with the first guideline 152 marked 4½ inches and with the second guideline 156 marked 4½ inches. The excess fabric of the strip will extend from the tool 110 when used in this manner. A rotary cutter (not shown) or other suitable cutting means is pressed down and moved along the fourth edge 124 until the desired fabric pattern is severed from the remainder of the fabric strip. The desired A pattern 200 piece as shown in FIG. 4 will remain under the tool 110 until the tool 110 is lifted. By multiplying the layers of fabric before emplacement under the tool 110, multiple identical copies of the fabric pattern can be created, easing the workload of the quilter. To create mirror images of a particular fabric pattern, the cloth strip should be doubled on itself prior to placement under the tool 110 and initiation of the cutting process.

Following the cutting of an initial A pattern 200, or set of A patterns 200 if multiple layers of fabric are used, the remainder of the fabric strip will contain a cut edge having the reverse angle of the A pattern 200. To continue cutting additional A patterns 200, and to maximize efficiency and minimize fabric waste, the tool 110 should be rotated so that the angled cut edge is aligned with the third guideline 140 and fourth guideline 144 corresponding with the width of the fabric strip. In the manner described above, the remainder of the fabric strip should be severed from the A pattern 200 which remains under the quilting tool 110. This results in a fabric strip remainder having a freshly cut right angle. The quilting tool 110 is rotated back to the original position, and the process repeated as many times as necessary.

To cut a B block 220 as shown in FIG. 5, the properly sized and trimmed fabric strip is first placed on a suitable cut resistant surface. This is followed by overlaying the quilting tool 110 of the present claimed invention on the fabric strip. Next, the fabric strip is positioned under the quilting tool 110 of the present claimed invention with the trimmed right angle end aligned with the vertical line 160. A longitudinal edge of the fabric strip (not shown) is aligned with the second guideline 156 marking indicating the size of the fabric strip. For example, a fabric strip with a width of 4½ inches would be aligned with the second guideline 156 corresponding with 4½ inches. A rotary cutter or other suitable cutting means is pressed down and moved along the fourth edge 124 until the desired fabric pattern is severed from the remainder of the fabric strip. The tool 110 is removed and the B block or blocks 220 is/are removed. The remainder of the fabric strip will contain a cut edge having the reverse angle of the B block 220.

To maximize efficiency and minimize waste, if additional B blocks 220 are desired, the quilting tool 110 is reversed. Using the third set of guidelines 140 and reference line 148, align the angled edge of the fabric strip with the third guideline 140 corresponding with the width of the fabric strip. Using a rotary cutter or other suitable cutting means, press down with sufficient force to cut the fabric, while guiding the cutter along the third edge 122. The tool 110 can be reversed to its original orientation and the process can be repeated as many times as desired.

It is also possible to cut an A block 200 using the angled edge of the fabric strip remaining immediately after cutting a B block 220. This is performed by lifting the quilting tool 110 from the freshly cut prepared fabric strip, and rotating the tool 110 180 degrees. The rotated tool 110 is then laid over the fabric strip, aligning the member of the fourth set of guidelines 144 corresponding with the width of the prepared fabric strip with the angled, freshly cut edge of the fabric strip. The bottom edge of the fabric strip is aligned with the member of the third set of guidelines 140 corresponding with the width of the prepared fabric strip. The top edge of the fabric strip is aligned with the first edge 118 of the quilting tool 110. A rotary cutter or other suitable cutting means is pressed down and moved along the third edge 122 until the desired fabric pattern is severed from the remainder of the fabric strip. The tool 110 is removed and the A block or blocks 200 is/are removed. The remainder of the fabric strip will contain a cut edge having a right angle.

It is possible to cut a B block 220 using the angled edge of the fabric strip remaining immediately after cutting an A block 200. This is performed by lifting the quilting tool 110 from the freshly cut prepared fabric strip and reversing the tool 110 followed by laying the tool 110 over the prepared fabric strip. The reversed tool 110 is placed such that the reference line 148 is aligned with the freshly cut angled edge of the prepared fabric strip. The top edge of the fabric strip is aligned with the member of the third set of guidelines 140 corresponding with the width of the fabric strip. The bottom edge of the fabric strip should automatically be aligned with the first edge 118 of the quilting tool 110. A rotary cutter or other suitable cutting means is pressed down and moved along the third edge 122 until the desired fabric pattern is severed from the remainder of the fabric strip. The tool 110 is removed and the B block or blocks 220 is/are removed. The remainder of the fabric strip will contain a cut edge having a right angle.

What is claimed is:

1. A quilting tool, comprising:

a. a transparent plate having at least a first major surface and a second major surface, a straight edge and an angular edge, said angular edge intersects said straight edge at an angle of 116.6 degrees;

b. a first straight guideline imprinted on a major surface of said plate, said first straight guide line extending perpendicular to said straight edge; and c. a second straight guide line imprinted on a major surface of said plate, parallel with said straight edge, said second guideline perpendicularly intersecting said first guideline and terminating proximate to said angled edge.

2. The quilting tool of claim 1 wherein said transparent plate further comprises acrylic material.

3. The quilting tool of claim 2 wherein said acrylic material is ⅛ inch thick.

4. A quilting tool, comprising:

a. a transparent plate having a first major surface and a second major surface, at least a straight edge and an angular edge extending in an oblique direction, said angular edge intersecting with said straight edge to form an angle of 116.6 degrees;

b. a first set of longitudinally spaced, transversely extending and parallel guidelines imprinted on a major surface of said plate, said first set of guidelines extending perpendicular to said straight edge; and c. a second set of transversely spaced, longitudinally extending and parallel guidelines imprinted on a major surface of said plate, the individual guidelines of said second set of guidelines parallel with said straight edge, said second set of guidelines joining perpendicular to said first set of guidelines.

5. The quilting tool of claim 4 wherein said transparent plate further comprises acrylic material.

6. The quilting tool of claim 5 wherein said acrylic material is ⅛ inch thick.

7. A quilting tool, comprising:

a. a transparent plate having a first major surface and a second major surface, a first longitudinally extending edge which is the longest edge, a second longitudinally extending edge which is parallel to said first longitudinally extending edge, a third transversely extending edge which intersects and is perpendicular to said first and second extending edges, and a fourth obliquely extending edge which intersects with said second side to form an angle of 116.6 degrees;

b. a first set of guidelines imprinted on a major surface of said plate, the individual guidelines of said first set of guidelines parallel with each other and parallel with said third edge and perpendicular to said second side;

c. a second set of guidelines imprinted on a major surface of said plate, the individual guidelines of said second set of guidelines parallel with each other and parallel with said first edge and terminating proximate said first set of sub-guidelines;

d. a third set of guidelines imprinted on a major surface of said plate, the individual guidelines of said third set of guidelines parallel with each other and adjacent to and perpendicular to said third edge;

e. a fourth set of guidelines imprinted on a major surface of said transparent plate, the individual guidelines of said fourth set of guidelines parallel with each other and parallel with said fourth edge and extending from said first edge and terminating proximate the junction with said third set of guidelines;

f. a vertical line extending between said second edge and said first edge and at right angles thereto so as to define a trapezoid with said fourth edge, said first edge and said second edge, wherein the distance between said point of intersection of said second edge and said fourth edge and said vertical line is 0.40 inches; and g. a reference line extending from the second edge at a mirror image angle to the 116.6 angle formed by the intersection of the second edge and the fourth edge, to a point on the first edge 0.40 inches from the intersection of the first edge and the third edge.

8. The quilting tool of claim 7, further comprising:

a. said first, second, third and fourth sets of guidelines marked with alpha-numeric characters indicating the appropriate guideline to use with a particular width fabric strip.

9. The quilting tool of claim 7 further comprising:

a. a first set of seam lines, said first set of seam lines associated with and in equal number and parallel with said first set of guidelines;

b. a second set of seam lines, said second set of seam lines associated with in equal number and parallel with said second set of guidelines;

c. a third set of seam lines, said third set of seam lines associated with and in equal number and parallel with said third set of guidelines;

d. a fourth set of seam lines, said fourth set of seam lines associated with and in equal number and parallel with said fourth set of guidelines;

e. a seam line associated with and parallel with said first edge;

f. a seam line associated with and parallel with said second edge;

g. a seam line associated with and parallel with said third edge;

h. a seam line associated with and parallel with said fourth edge;

i. a seam line associated with and parallel with said reference line; and j. a seam line associated with and parallel with said vertical line.

10. The quilting tool of claim 9 further comprising the seam lines being ¼ inch from their associated guideline, edge, reference line or vertical line.

11. The quilting tool of claim 7 wherein said transparent plate further comprises acrylic material.

12. The quilting tool of claim 8 wherein said transparent plate further comprises acrylic material.

13. The quilting tool of claim 8 wherein said acrylic material is ⅛ inch thick.

14. The quilting tool of claim 9 wherein said acrylic material is ⅛ inch thick.

15. A method of using the quilting tool of claim 7, comprising the steps of:

a. preparing a fabric strip having a width including a seam allowance used for creating a hidden seam and having a trimmed end with a ninety degree angle;

b. placing said fabric strip on a suitable cutting surface;

c. overlaying said quilting tool of claim 7 with said second major surface contacting said fabric strip;

d. aligning said quilting tool over said fabric strip so that the width of said fabric strip is covered by said quilting tool and one edge of said fabric strip width is aligned with said second guideline corresponding with the width of said fabric strip, and leaving an amount of fabric strip sufficient to extend at least to said fourth edge of said quilting tool;

e. aligning said trimmed edge of said fabric strip with said first guideline corresponding with said width of said fabric strip;

f. cutting said fabric strip along said fourth edge of said quilting tool;

g. removing said quilting tool from said cutting surface; and h. removing a cut fabric block from said cutting surface.

16. The method of claim 15 further comprising multiple layers of fabric strips aligned with each other prior to overlaying said quilting tool.

17. The method of claim 15 further comprising:

a. removing and rotating said quilting tool 180 degrees following making the first cut in said fabric strip;

b. aligning said quilting tool over the cut, angled end of said fabric strip so that said third and fourth guidelines correspond to the width of said fabric strip such that a piece of fabric identical in shape and size to said cut previously fabric pattern is completely covered by said quilting tool; and c. cutting said fabric strip along said third edge of said quilting tool.

18. A method of using the quilting tool of claim 7, comprising the steps of:

a. preparing a fabric strip having a width including a seam allowance used for creating a hidden seam and having a trimmed end with a ninety degree angle;

b. placing said fabric strip on a suitable cutting surface;

c. overlaying said quilting tool of claim 7;

d. aligning said quilting tool over said fabric strip so that the width of said fabric strip is covered by said quilting tool and one edge of said fabric strip width is aligned with said second guideline corresponding with the width of said fabric strip and leaving an amount of fabric strip sufficient to extend at least to said fourth edge of said quilting tool;

e. aligning said trimmed end of said fabric strip with said vertical line; and f. cutting said fabric strip along said fourth edge of said quilting tool.

19. The method of claim 18, further comprising multiple layers of fabric strips aligned with each other prior to overlaying of said quilting tool.

20. The method of claim 18, further comprising:

a. removing said quilting tool from said fabric strip;

b. reversing said quilting tool;

c. overlaying said quilting tool over said fabric strip;

d. aligning said quilting tool so that the cut, angled end of said fabric strip is aligned with said third guideline corresponding to said width of said fabric strip and said reference line such that an amount of fabric strip extends to said third edge of said quilting tool; and e. cutting said fabric strip along said third edge of said quilting tool.

21. The method of claim 15, further comprising the steps of:

a. removing said quilting tool from said fabric strip;

b. reversing said quilting tool;

c. overlaying said quilting tool over said fabric strip;

d. aligning said quilting tool so that the cut, angled end of said fabric strip is aligned with said reference line and said third guideline corresponding with said width of said fabric strip; and e. cutting said fabric strip along said third edge of said quilting tool.

22. The method of claim 21, further comprising multiple layers of fabric strips aligned with each other prior to the overlaying of said quilting tool.

23. The method of claim 18, further comprising the steps of:

a. removing said quilting tool from said fabric strip;

b. rotating said quilting tool 180 degrees;

c. overlaying said quilting tool over said fabric strip;

d. aligning said quilting tool so that said cut, angled edge of said fabric strip is aligned with the member of the fourth set of guidelines corresponding with the width of said fabric strip and a bottom edge of said fabric strip is aligned with said member of said third set of guidelines corresponding with the width of said fabric strip; and e. cutting said fabric strip along said third edge.

24. The method of claim 23, further comprising multiple layers of fabric strips aligned with each other prior to the overlaying of said quilting tool.

* * * * *